US006834480B1

(12) United States Patent
Ishino et al.

(10) Patent No.: US 6,834,480 B1
(45) Date of Patent: Dec. 28, 2004

(54) PACKAGING SYSTEM INCORPORATING A PRINTER

(75) Inventors: Akira Ishino, Shiga (JP); Katsuaki Kouno, Shiga (JP); Colin Buckley, Birmingham (GB)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 09/417,604

(22) Filed: Oct. 14, 1999

(30) Foreign Application Priority Data

Oct. 15, 1998 (JP) ..... 10-314042

(51) Int. Cl.[7] ..... B65B 9/06
(52) U.S. Cl. ..... 53/551; 53/55
(58) Field of Search ..... 53/551, 411, 55; 493/8

(56) References Cited

U.S. PATENT DOCUMENTS 4,548,024 A * 10/1985 Fine ..... 53/502
5,097,652 A * 3/1992 Inamura et al.
5,463,850 A * 11/1995 Fukuda
5,479,756 A * 1/1996 Haze et al.
5,537,798 A * 7/1996 Fukuda et al.
6,041,574 A * 3/2000 Bennett
6,088,994 A * 7/2000 Nakagawa et al.

FOREIGN PATENT DOCUMENTS

GB 2038758 10/1978

* cited by examiner

*Primary Examiner*—Eugene Kim
(74) *Attorney, Agent, or Firm*—Beyer Weaver & Thomas LLP

(57) ABSTRACT

A packaging system includes, in addition to a packaging machine of a known form-fill-seal type and a printer for printing on a bag-making film, a packaging condition memory which stores packaging conditions for operating the packaging machine, a print data memory which stores print data for operating the printer, and a correlation data memory which stores the correlation data between the packaging conditions and the print data. If a packaging condition is selected through an input device, not only is the packaging machine operated under the specified condition but also the printer is operated by the data which correspond to the selected packaging condition according to the correlation data stored in the correlation data memory.

13 Claims, 7 Drawing Sheets

| PACKAGING CONDITION No. | PACKAGING CONDITION NAME | BAG LENGTH | BAG WIDTH | SPEED | SEAL TIME |
|---|---|---|---|---|---|
| ⋮ | ⋮ | ⋮ | ⋮ | ⋮ | ⋮ |
| 3 | Snack Salted 30g | 130 | 120 | 90 | 200 |
| 4 | Chips Salted 70g | 130 | 250 | 45 | 200 |
| 5 | Chips Salted 30g | 130 | 130 | 90 | 120 |
| ⋮ | ⋮ | ⋮ | ⋮ | ⋮ | ⋮ |

FIG. 3A

| PRINT DATA No. | PRINT DATA NAME | FONT | LETTER SIZE | LETTER SPACE | LINE SPACE | WIDTH POSITION | LENGTH POSITION | BAR CODE |
|---|---|---|---|---|---|---|---|---|
| 10 | Chips A | Gothic | 10 | 4 | 8 | 357 | 45 | No |
| 11 | Chips B | Gothic | 10 | 4 | 8 | 357 | 45 | No |
| 12 | Snack C | Mincho | 12 | 3 | 7 | 300 | 30 | Yes |
| 13 | Snack D | Mincho | 12 | 3 | 7 | 300 | 30 | Yes |

FIG. 3B

| PACKAGING CONDITION No. | PRINT DATA No. |
|---|---|
| 3 | 12 |
| 4 | 10 |
| 5 | 11 |

FIG. 3C

PACKAGING SYSTEM INCORPORATING A PRINTER

BACKGROUND OF THE INVENTION

This invention relates to a packaging system. It has been known to form a system incorporating both a packaging machine and a printer for making packages. Japanese Patent Publication Tokkai 4-128105, for example, disclosed such a system incorporating a so-called vertical pillow type form-fill-seal package maker and a printer. An elongated bag-making material, herein referred to as the film, is pulled out of a roll and after data such as the date of production of the packaged products are printed thereon by the printer, the film is bent and made into a tubular form by means of a longitudinal sealer adapted to seal the mutually overlapped side edges of the film together. After articles to be packaged are dropped into this tubularly formed film, it is transversely sealed above the articles captured inside and cut, and this production process is repeated.

Since films with different sizes and different designs thereon are used for producing packaged products of different kinds, however, the initial position at which the printer should start printing also changes, depending on the kind of products to be made. Thus, data related to the printing such as the printing position must be set, as well as packaging conditions such as the width and the length of the bags to be formed, for each of different kinds of products to be packaged. Such setting operations are cumbersome to perform because the conditions for the packaging and the data related to the printing are separately set by using independent controllers of the packaging machine and the printer, respectively. Moreover, every time the kind of products to be produced is changed, not only new packaging conditions but also new data for the printing corresponding to these packaging conditions must be set. Thus, errors have been likely to occur in setting these conditions and data.

SUMMARY OF THE INVENTION

It is therefore an object of this invention to provide an improved packaging system incorporating a printer with which data for the printing can be easily set corresponding to a selected packaging condition such that errors in the setting of these data are not likely to occur.

A packaging system embodying this invention, with which the above and other objects can be accomplished, may be characterized as comprising not only a packaging machine of a known kind, which transports a bag-making film, forms it into a tubular form, fills it with articles to be packaged and seals it to produce a packaged product, and a printer, also of a known kind, disposed along the film path for making prints on the film, but also a packaging condition memory which stores packaging conditions for operating the packaging machine, a print data memory which stores print data for operating the printer, and a correlation data memory which stores the print data in correlation with the packaging conditions. These memories are parts of a control unit for the system and, when a packaging condition is selected through an input device, not only is the packaging machine operated under the specified condition but also the printer is operated by the data which correspond to the selected packaging condition according to correlation data stored in the correlation data memory.

With a system thus characteristically structured, the packaging conditions for the packaging machine and the print data for the printer can be set automatically, and hence easily, in a properly correlated manner. Since this correlation is stored in one of its memory devices, errors in matching a packaging condition and print data can be reliably avoided. Throughout herein, the expression "packaging conditions" is used to indicate conditions for operating the packaging machine such as the length and width of the bags to be produced and the number of packaged products to be produced thereby. Expressions "print data" will be used to indicate items such as the position of printing, the font and size of the characters to be printed, and the intervals between characters and lines of characters.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIGS. 3A and 3B and 3C show schematically how data are stored respectively in the packaging condition memory, the print data memory and the correlation data memory.

DETAILED DESCRIPTION OF THE INVENTION

Figure 1:
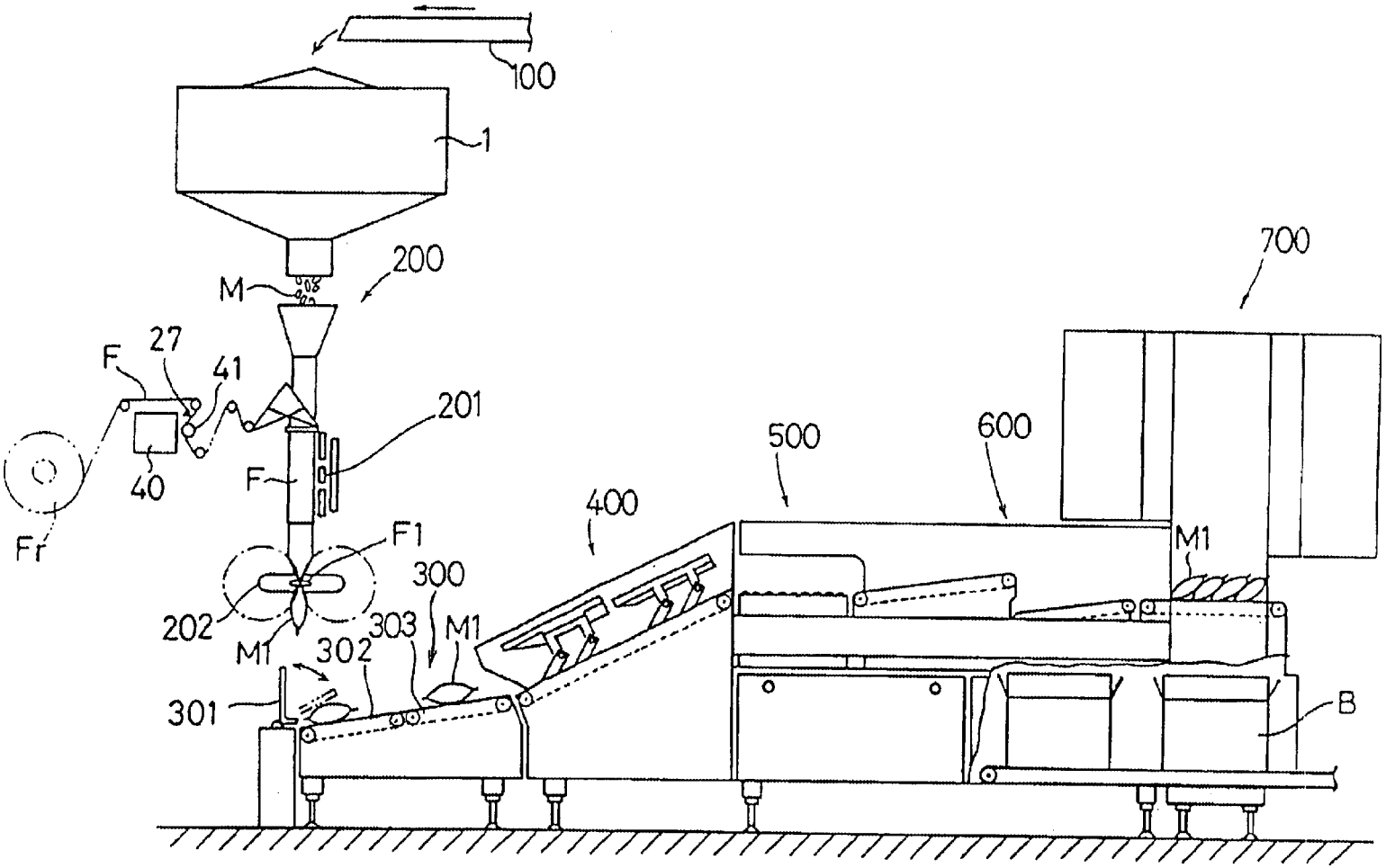
FIG. 1 is a schematic side view of a packaging system embodying this invention including a boxing system for putting packaged products into boxes.

The invention is described next by way of an example. FIG. 1 shows a packaging system embodying this invention, including a conveyor 100, a combinational weigher 1, a form-fill-seal package making machine (herein referred to as the "packaging machine") 200, a weight checker 300 and a boxing machine 700. The conveyor 100 is for transporting articles M to be packaged to form products M1 and dropping them to the combinational weigher 1. The combinational weigher 1 is of a known kind, serving to combine the articles M supplied into a plurality of its weigh hoppers (not shown) to select a combination having a desired total weight satisfying a preliminarily determined condition with respect to a target weight and to drop the articles M of the selected combination. The packaging machine 200 is of a so-called vertical pillow type, serving to pull a film F out of a film roll Fr, to longitudinally seal its mutually overlapped side edges by means of a longitudinal sealer 201 to make it into a tubular form and, after the articles M dropped from above fills the tubularly formed film F, to transversely seal it transversely at a seal position F1 above the captured articles by means of a transverse sealer 202 (as described, for example, in Japanese Patent Publication Tokkai 4-128105).

A printer 40 and a print roller 41 are disposed by the path along which the film F is transported from the film roll Fr to the longitudinal sealer 201. The printer 40 may be of a thermal transfer type which prints one line at a time by pressing a heated printer head onto an ink ribbon as the film F passes between the printer 40 and the print roller 41.

Packaged products M1 are dropped one at a time from the packaging machine 200, pushed by a pusher 301 (the movement of which is indicated by a double-headed arrow) to fall in the forward direction (to the right in FIG. 1) onto a receiving conveyor 302, and transported to the boxing machine 700 on the downstream end, passing through the weigher conveyor 303, a seal checker 400, a sorter 500 and an aligner 600. The boxing machine 700 is for placing these packaged products M1 in cardboard boxes B.

Figure 2:
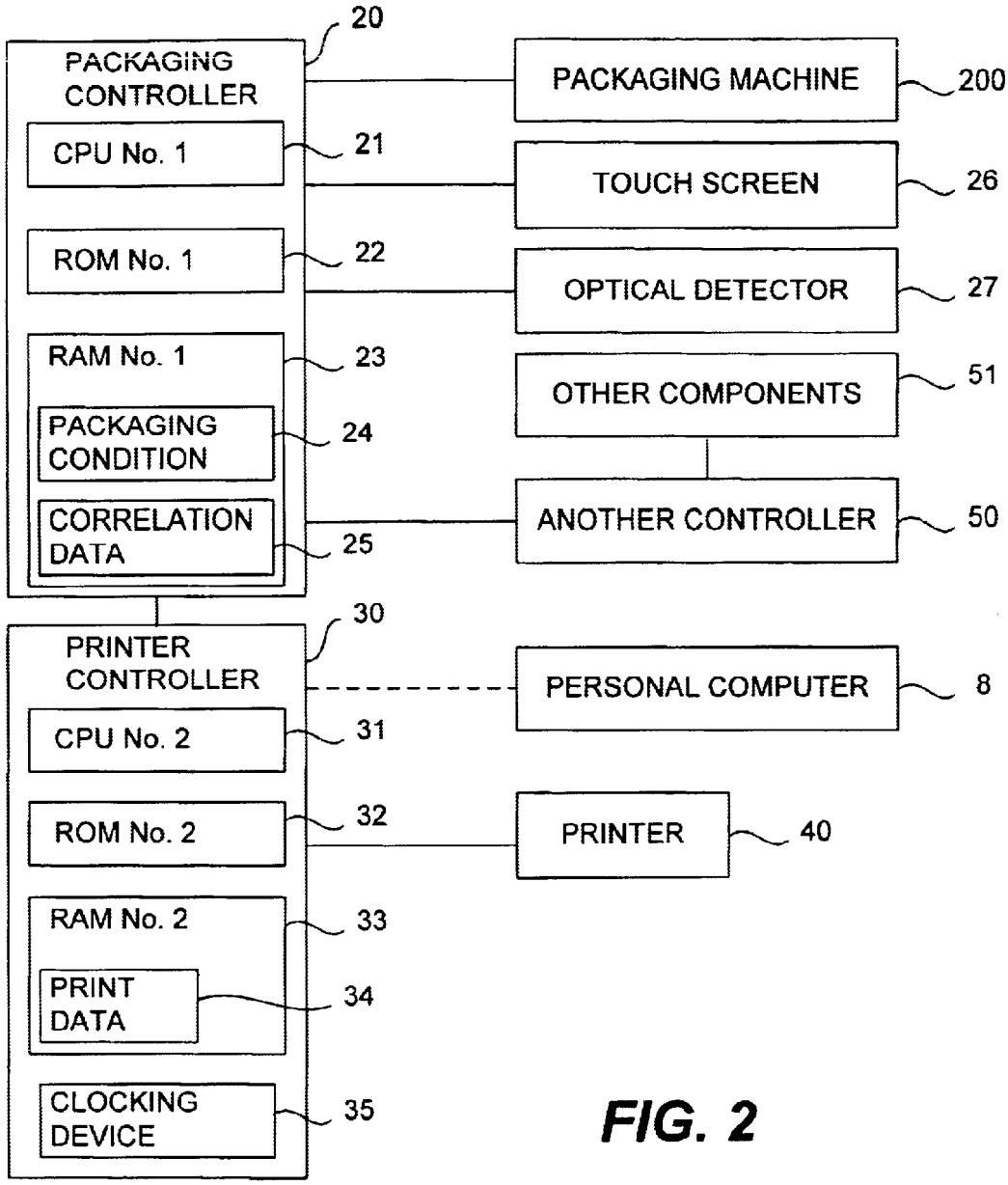
FIG. 2 is a block diagram of a control part of the packaging system of FIG. 1.

Next, the control part of the packaging system shown in FIG. 1 will be described. As schematically shown in FIG. 2, a packaging controller 20 and a printer controller 30 are respectively connected through an interface (not shown) to the packaging machine 200 and the printer 40, and they are themselves connected to each other through another interface (not shown). Another controller 50 for controlling other components (indicated summarily by numeral 51) such as the combinational weigher 1, the weight checker 300, the seal checker 400 and the boxing machine 700 is also connected to the packaging controller 20 through still another interface (not shown).

The packaging controller 20 includes a CPU, a ROM and a RAM (herein respectively referred to as the "first CPU" or "CPU No. 1" 21, the "first ROM" or "ROM No. 1" 22 and the "first RAM" or "RAM No. 1" 23. The first RAM 23 includes a memory (herein referred to as the "packaging condition memory 24" for storing packaging conditions such as the packaging condition numbers, packaging condition names (or product names), bag length, back width, packaging speed (or the number of packaged products M1 produced per minute) and the timing of sealing, as shown in FIG. 3A, in a mutually correlated manner. There is also another memory (herein referred to as the "correlation data memory 25"), to be described below, included in the first RAM 23. The first CPU 21 serves to control the package making operations of the packaging machine 200 on the basis of packaging conditions retrieved from the packaging condition memory 24.

Figure 4A:
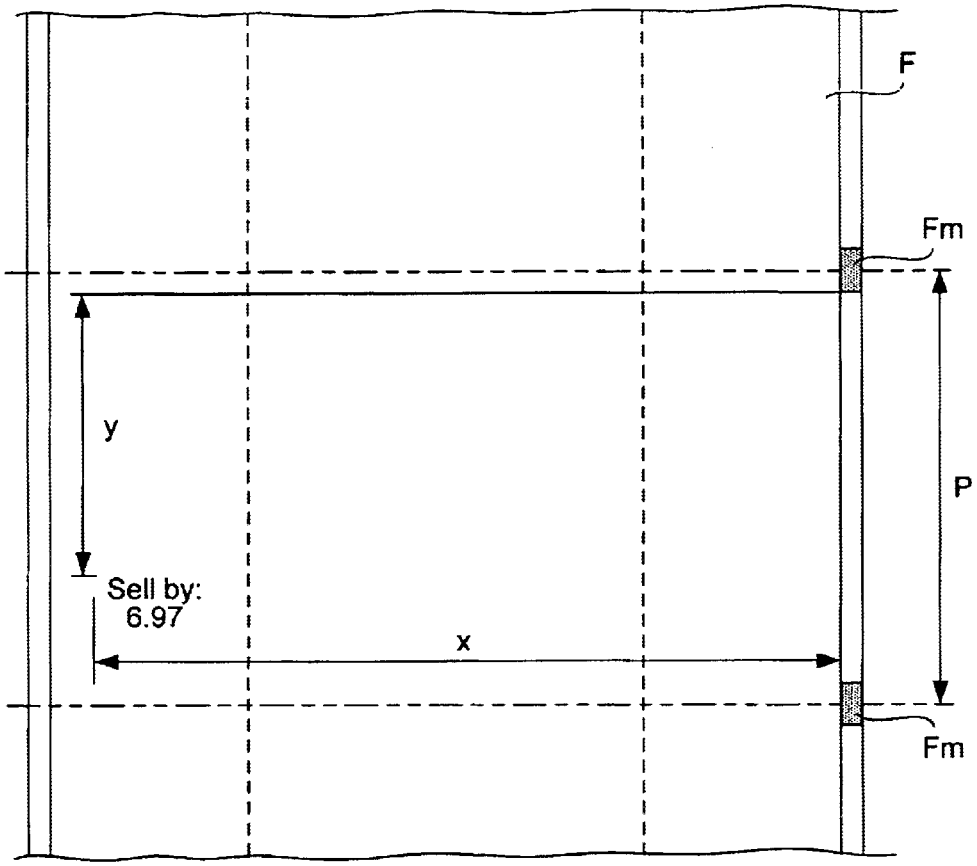
FIG. 4A, is a plan view of a portion of the film.
Figure 4B:
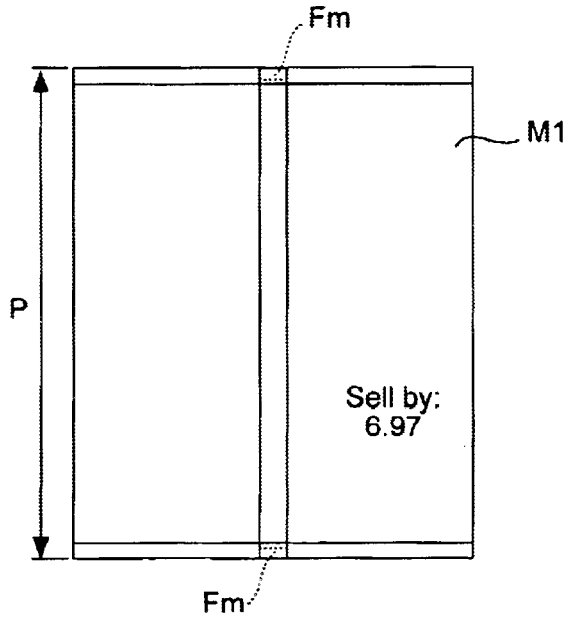
FIG. 4B is a plan view of a packaged product.

As shown in FIGS. 4A and 4B, marks Fm are already printed on the right-hand side edge of the film F at a specified pitch P equal to the length of the bags to be made therefrom. These marks Fm serve as reference positions not only for the transverse sealing but also for the printing. An optical detector 27, disposed between the film roll Fr and the printer 40 as shown in FIG. 1, for detecting these marks Fm is connected through an interface (not shown) to the packaging controller 20. Whenever the optical detector 27 detects one of these marks Fm as the film F is unwound from the roll Fr during the course of a normal packaging operation, a detection signal is outputted therefrom to the packaging controller 20. When this signal is received, the first CPU 21 responds by outputting a print command to the printer controller 30, causing the printer 40 to start its printing operations at a specified timing.

A touch screen 26 is also connected to the packaging controller 20, serving in well known manners not only as a display means for displaying various data and/or menus on its display screen but also as an input means for allowing the user to make an input by touching the screen with a finger at indicated positions.

Figure 4C:
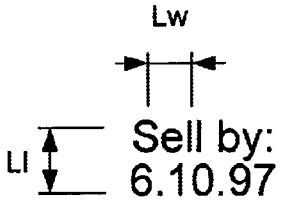
FIG. 4C is a plan view of the printed portion of the film to define the meaning of line width and line interval.

The printer controller 30 includes a CPU, a ROM, a RAM (which are respectively referred to as the "second CPU" or "CPU No. 2" 31, the "second ROM" or "ROM No. 2" 32, and the "second RAM" or "RAM No. 2" 33) and a time-counting clocking device 35, as shown in FIG. 2. The second RAM 33 includes a memory (herein referred to as the "print data memory 34") for storing print data such as print data numbers, print data names, font to be used for the printing, character size, line width Lw, line interval L1, and printing positions x and y, as shown in FIG. 3B, in a mutually correlated manner. The printing positions x and y respectively indicate the distance in the transverse direction between the mark Fm and the left-hand edge of the printing position and the distance in the lengthwise direction between the mark Fm and the upper edge of the printing position. As shown in FIG. 4C, the line width Lw means the pitch between mutually adjacent characters in a line and the line interval L1 means the pitch between mutually adjacent lines. These print data are preliminarily stored in the print data memory 34 and may be inputted through a personal computer 8, as shown in FIG. 2, adapted to be connected through an interface (not shown) to the printer controller 30 whenever necessary.

The clocking device 35, included in the printer controller 30, serves to output the current date to the second CPU 31. The second CPU 31 treats this received current date as the production date and calculates the last date, or expiration date, by which the packaged product should be sold, or consumed, by adding a specified number of days to the current date. When the print command outputted from the packaging controller 20 is received, the second CPU 31 causes the printer 40 to print these dates, as well as words such as "Sell by" and the name of the production plant, on the basis of the print data.

As shown in FIG. 3C, the correlation data memory 25 stores the packaging condition numbers and the print data numbers in a correlated manner. The first CPU 21 serves to output to the printer controller 30 the printing condition numbers corresponding to inputted packaging condition numbers.

Next, the operation of the packaging system of this invention will be explained. First, the registration process will be described.

Figure 5A:
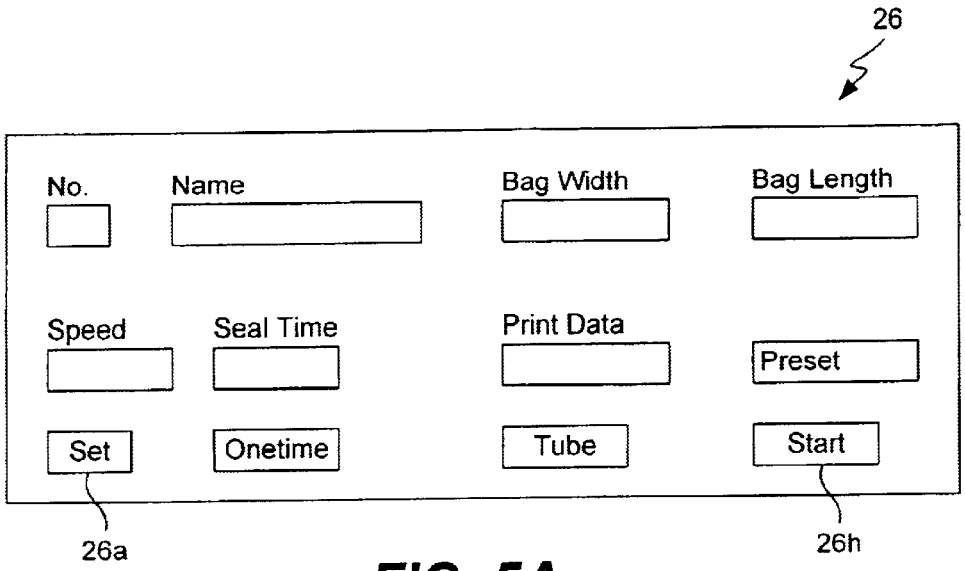
FIGS. 5A, 5B, 5C and 5D are examples of a display which may appear on the touch screen on various occasions.
Figure 5B:
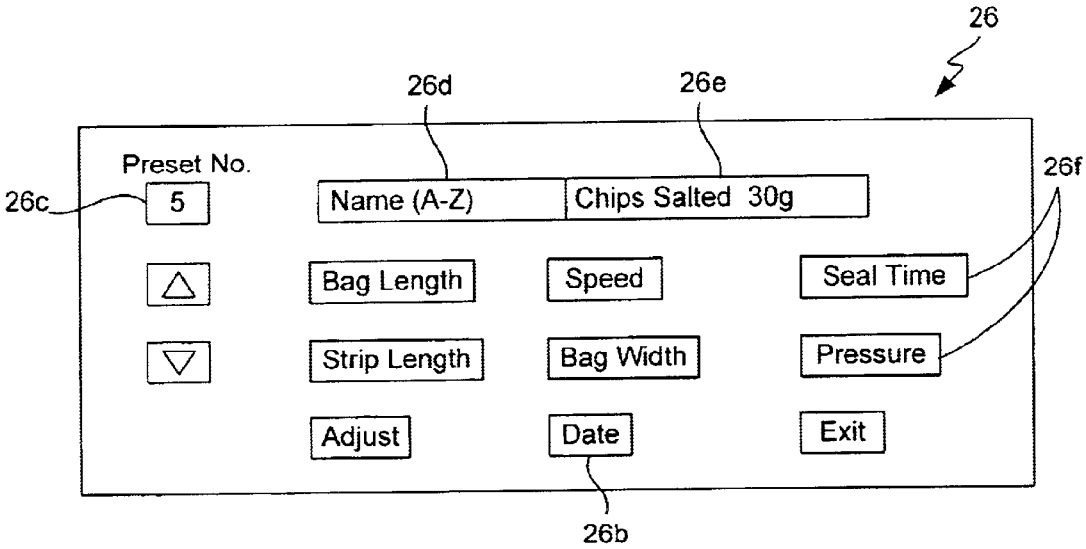

When the system is started up, a display as shown in FIG. 5A appears on the touch screen 26, including display columns such as "No." for packaging condition number, "Name" for packaging condition name, "Bag Width", "Bag Length", "Speed," and "Print Data" as well as buttons such as "Set" for a set button 26*a* and "Start" for a start button 26*h*. When the operator touches the set button 26*a*, a display as shown in FIG. 5B appears for setting packaging conditions. This display includes not only an input box 26*c* for the packaging condition number ("Preset No.") and a name selection button ("Name (A–Z)") 26*d* but also buttons for setting a bag length, a speed and a bag width, as well as a print data selecting button 26*b* ("Date"). The operator touches the name-input box 26*e* to display an input screen (not shown) with letter and number buttons and, after a packaging condition number and a packaging condition name are inputted, packaging conditions are inputted by touching input buttons 26*f* on the screen, The first CPU 21 then stores the inputted values in the packaging condition memory 24. The packaging conditions stored in the packaging condition memory 24 can be displayed as a list by touching the name selection button 26*d* and selections can also be made from this displayed list.

Figure 5C:
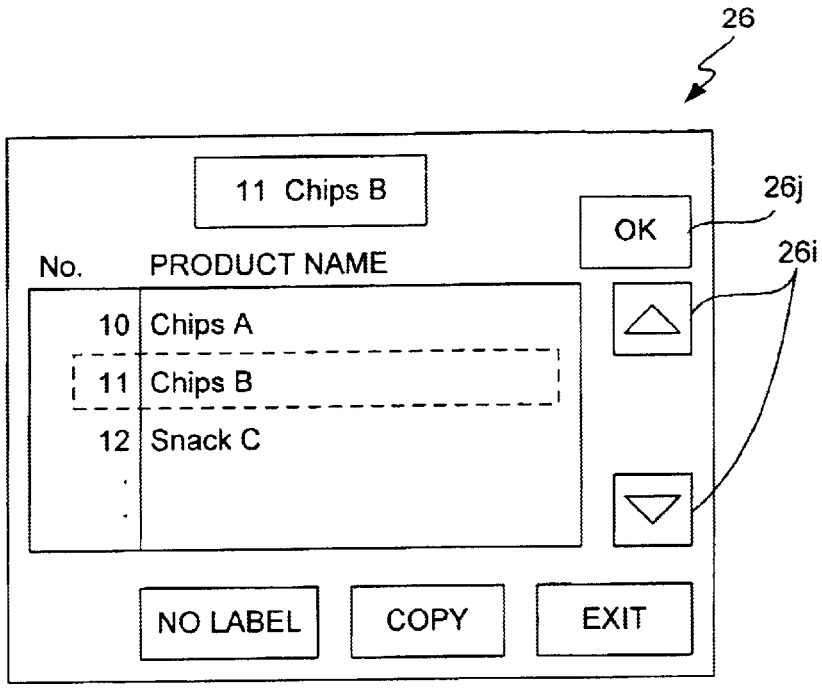
Figure 5D:
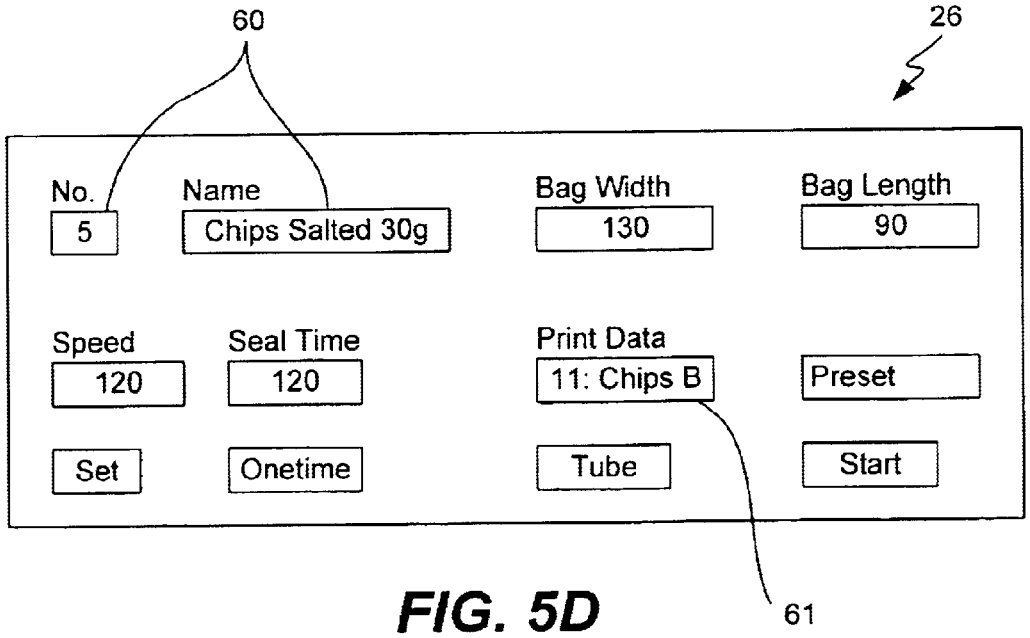

If the operator touches the print data selection button 26*b* thereafter, the second CPU 31 retrieves the print data number and print data name from the print data memory 34 and outputs them to the packaging controller 20, while the first CPU 21 displays a screen as shown in FIG. 5C for selecting print data, including not only the print data number and the print data name but also scroll buttons 26*i* and a setting ("OK") button 26*j*. The operator touches the scroll buttons 26*i* to scroll the screen and touches the print data No. or the print data name of the print data corresponding to the packaging condition set, as explained above, on the screen for selecting packaging conditions. If the operator touches the setting button 26*j* thereafter, the first CPU 21 functions to correlate this print data number with the packaging condition number and stores this correspondence in the correlation data memory 25. Thereafter, the packaging condition name and the packaging condition number which have been set are displayed in their respective display boxes ("No." and "Name") 60, and the corresponding print data number and print data name are displayed in the corresponding box 61, as shown in FIG. 5D.

In summary, packaging conditions for the packaging machine 200 and print data for the printer 40 can be set in proper correlation and inputted from the single packaging controller 20.

For retrieving print data stored in the correlation data memory 25, the operator selects a packaging condition number on a display (not shown) for retrieving packaging conditions, causing the first CPU 21 to search the correlation data memory 25 on the basis of the packaging condition number and to retrieve and output to the printer controller 30 the corresponding print data number. On the basis of this print data number received from the first CPU 21, the second CPU 31 sets to the printer 40 the print data from the print data memory 34 corresponding to this print data number. At the same time, the first CPU 21 causes to display on the touch screen 26 not only the specified packaging condition number and the packaging condition but also the print data number and the print data name, as shown in FIG. 5D.

When the production of the packaged products M1 is started thereafter by setting up the other components 51 of the system by controlling what was referred to above as "another controller 50", the packaging machine 200 carries out package making operations on the basis of the packaging conditions set by the packaging controller 20 and the printer 40 begins to print on the basis of the print data corresponding to these packaging conditions.

In summary, the correspondence between the packaging conditions for the packaging machine 200 and the print data for the printer 40 is stored in the correlation data memory 25. If correlation data from the correlation data memory 25 are retrieved once, it becomes unnecessary from the next time to set the printer controller 30. Another advantage is that the operator can be protected against the danger of making errors in setting data because the correlation data are stored in the correlation data memory 25.

Figure 6:
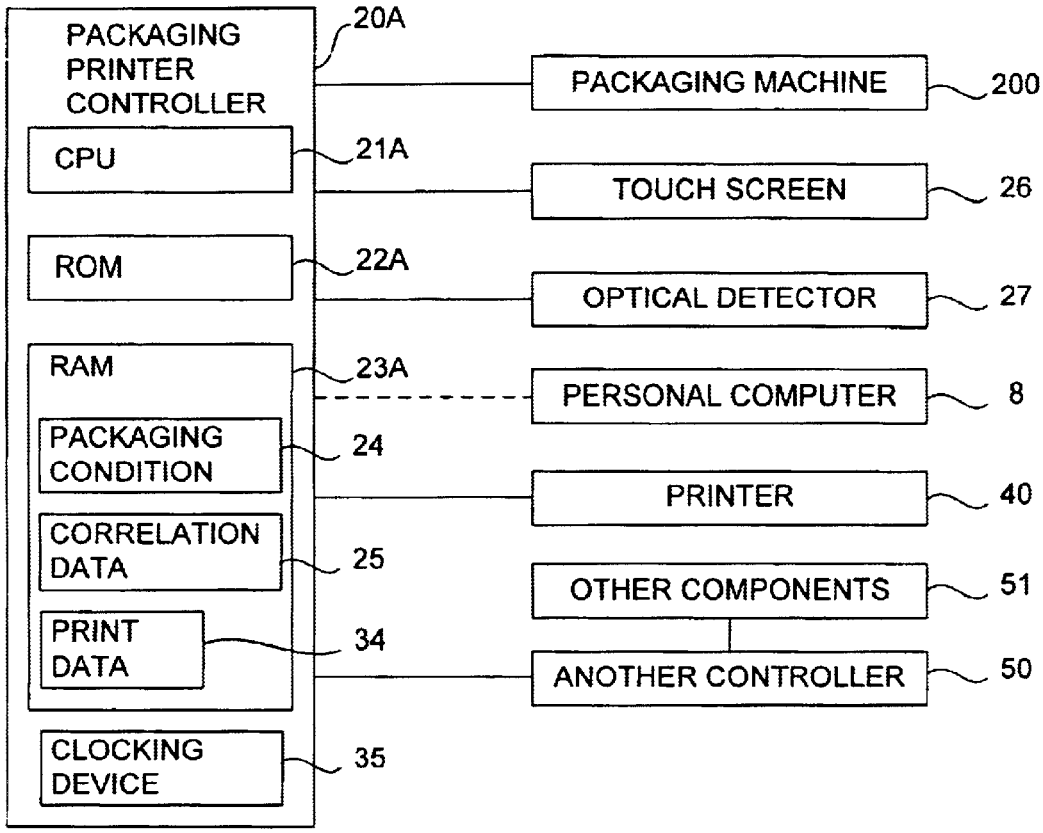
FIG. 6 is a block diagram of a control part of another packaging system embodying this invention, in which like or equivalent components are indicated by the same numerals as in FIG. 2.

The example described above is not intended to limit the scope of the invention. Many modifications and variations are possible within the scope of the invention. FIG. 6 shows another embodiment of the invention characterized wherein use is made of a single packaging-printing controller 20A which possesses the functions of both the packaging controller 20 and the printer controller 30. As shown in FIG. 6, the packaging-printing controller 20A also comprises a CPU 21A, a ROM 22A, a RAM 23A and a clocking device 35, the RAM 23A including a packaging condition memory 24, a correlation data memory 25 and a print data memory 34. A packaging machine 200, a touch screen 26, an optical detector 27, a printer 40 and another controller 50 as described above are each connected to this packaging-printing controller 20A through a respective interface (not shown). In other words, the packaging conditions of the packaging controller 20 and the print data of the printer controller 30 may be correlated by means of the single packaging-printing controller 20A. The touch screen 26 may be used for inputting print data such that the personal computer 8 of FIG. 6 can be dispensed with. Moreover, the setting of the other components 51 of the system, such as the combinational weigher 1, may be carried out by using the same packaging-printing controller 20A, instead of the controller 50 connected to these other components 51.

The disclosure is intended to be interpreted broadly. For example, although the printer 40 was described above as a device for directly making prints on the film F, a combination of a label printer for making prints on a label and a label applicator for attaching a printed label on the film F is intended to be also included what is herein referred to as the "printer".

In summary, the present invention makes it possible to set and input packaging conditions for a packaging machine and print data for a printer in a correctly correlated manner for a packaging system incorporating both the packaging machine and the printer. By storing data on this correlation in a memory, the operator is no longer required to set many mutually correlated data at the beginning of each operation. This reduces the probability of an input error in correlating packaging and printer data.

What is claimed is:

1. A packaging system comprising:

a packaging machine which continuously transports a bag-making film along a path while forming said film into a tubular form, fills said tubularly formed film with articles to be packaged inside a bag having a specified bag length and seals said film to produce a packaged product;

a printer and a print roller disposed along said path for printing specified print data on said film as said film passes continuously between said printer and said print roller and causing said printed specified print data to appear on said film;

a packaging condition memory which stores packaging conditions for operating said packaging machine including said bag length and packaging speed for operating said packaging machine;

a print data memory which stores print data from which said specified print data are specified; and a correlation data memory which stores correlation data between said print data and said packaging conditions, said correlation data memory storing specified ones of said print data in correlation with specified ones of said packaging conditions.

2. The packaging system of claim 1 further comprising an input device for allowing a user to input specified ones of said packaging conditions.

3. The packaging system of claim 2 wherein said correlation data memory stores corresponding ones of said print data in correlation with those of said packaging conditions specified through said input device.

4. The packaging system of claim 1 further comprising a display device for displaying said print data in correlation with said packaging conditions.

5. The packaging system of claim 2 further comprising a display device for displaying corresponding ones of said print data in correlation with said specified ones of said packaging conditions.

6. The packaging system of claim 3 further comprising a display device for displaying said corresponding ones of said print data in correlation with said specified ones of said packaging conditions.

7. The packaging system of claim 1 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

8. The packaging system of claim 1 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

9. The packaging system of claim 2 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

10. The packaging system of claim 3 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

11. The packaging system of claim 4 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

12. The packaging system of claim 5 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

13. The packaging system of claim 6 wherein said packaging condition memory, said print data memory and said correlation data memory are parts of a controller means for operating said packaging machine according to a selected one of said packaging conditions and said printer by data in said print data memory correlated to said selected packaging condition according to said correlation data in said correlation data memory.

* * * * *